US009336793B2

(12) United States Patent
Huang et al.

(10) Patent No.: US 9,336,793 B2
(45) Date of Patent: May 10, 2016

(54) CONTROLLER FOR AUDIO DEVICE AND ASSOCIATED OPERATION METHOD

(71) Applicant: MStar Semiconductor, Inc., Hsinchu Hsien (TW)

(72) Inventors: Hung-Chi Huang, Hsinchu County (TW); Cheng-Lun Hu, Hsinchu County (TW)

(73) Assignee: MSTAR SEMICONDUCTOR, INC., Hsinchu Hsien (TW)

( * ) Notice: Subject to any disclaimer, the term of this patent is extended or adjusted under 35 U.S.C. 154(b) by 30 days.

(21) Appl. No.: 14/471,578

(22) Filed: Aug. 28, 2014

(65) Prior Publication Data

US 2015/0063580 A1 Mar. 5, 2015

(30) Foreign Application Priority Data

Aug. 28, 2013 (TW) ..... 102130888 A

(51) Int. Cl.
*G10L 21/0208* (2013.01)
*H04R 3/00* (2006.01)
*G10L 21/0216* (2013.01)

(52) U.S. Cl.
CPC ... *G10L 21/0208* (2013.01); *G10L 2021/02082* (2013.01); *G10L 2021/02166* (2013.01); *H04R 3/005* (2013.01)

(58) Field of Classification Search
None
See application file for complete search history.

(56) References Cited

U.S. PATENT DOCUMENTS 8,175,871 B2 * 5/2012 Wang ..... H04M 9/082 379/406.01
8,498,423 B2 * 7/2013 Thaden ..... G10L 21/02 370/289
9,106,196 B2 * 8/2015 Hetherington ..... H03G 3/20
2010/0215184 A1 * 8/2010 Buck ..... H04M 9/082 381/66
2013/0034241 A1 * 2/2013 Pandey ..... H04R 29/007 381/92
2013/0083934 A1 * 4/2013 hgren ..... G10K 11/34 381/58
2014/0278394 A1 * 9/2014 Bastyr ..... G10L 21/0208 704/233

FOREIGN PATENT DOCUMENTS

CN 103229238 7/2013
TW I346323 8/2011

OTHER PUBLICATIONS

Taiwan Patent Office, "Office Action," Apr. 24, 2015.

* cited by examiner

*Primary Examiner* — Paul Huber
(74) *Attorney, Agent, or Firm* — WPAT, PC; Justin King

(57) ABSTRACT

A controller for an audio device is provided. The controller receives a first collected sound signal and a second collected sound signal respectively provided by two microphones, and includes an echo cancellation module and a beamforming module. The echo cancellation module performs echo cancellation on the first collected sound signal to accordingly provide an intermediate signal. The beamforming module performs beamforming by utilizing the echo-cancelled intermediate signal and the non-echo-cancelled second collected sound signal.

8 Claims, 5 Drawing Sheets

| | ERLE | computation amount |
|---|---|---|
| FIG. 1 (prior art) | ~13 | 75 MHz |
| FIG. 2 | ~22 | 125 MHz |
| FIG. 3 | ~22 | 75 MHz |
| | (the higher the better) | (the lower the better) |

FIG. 4

CONTROLLER FOR AUDIO DEVICE AND ASSOCIATED OPERATION METHOD

This application claims the benefit of Taiwan application Serial No. 102130888, filed Aug. 28, 2013, the subject matter of which is incorporated herein by reference.

BACKGROUND OF THE INVENTION

1. Field of the Invention

The invention relates in general to a controller for an audio device and an associated operation method, and more particularly to an audio device controller that effectively improves a sound collecting effect with a low computation amount, and an associated operation method.

2. Description of the Related Art

Audio devices that can collect and/or play sounds play an essential role in the modern information society. Devices that support voice control are also regarded as audio devices. For example, audio devices cover cell phones, digital cameras/video cameras, navigation/positioning systems, wearable/handheld/portable calculators/electronic books/electronic dictionaries/computers that produce sounds and receive voice control, televisions, sound systems, multimedia players, toys with voice control, and interactive artworks.

FIG. 1 shows a schematic diagram of a conventional audio device 10, which is capable of playing sounds and receiving voice control. The audio device 10 includes microphones 12*a* and 12*b*, speakers 14*a* and 14*b*, a controller 20, an audio output module 23, and a playback module 24. The microphones 12*a* and 12*b* collect sounds, and convert the collected sounds to signals Si_L and Si_R. The signals Si_L and Si_R are transmitted to the controller 20.

The controller 20 includes a beamforming module 16, an echo cancellation module 18, and a speech recognition module 22. The audio output module 23 provides signals Sp_L and Sp_R as audio source signals. The playback module 24 performs playback according to the signals Sp_L and Sp_R. For example, the playback module 24 drives the speakers 14*a* and 14*b* according to the signals Sp_L and Sp_R, respectively, to play the signals Sp_L and Sp_R as sounds.

To realize the voice control function, the audio device 10 needs to focus at a position of a user to centrally collect a voice control command issued by the user. Since sounds played by the speakers 14*a* and 14*b* form an echo that can be received by the microphones 12*a* and 12*b*, the audio device 10 also needs to prevent the speakers 14*a* and 14*b* from affecting the sound collection. In the controller 20 of the conventional audio device 10, the beamforming module 16 primarily utilizes the signals Si_L and Si_R for beamforming to accordingly provide a signal Sm1. One object of the beamforming is to enhance the sound within a certain focal area in the signal Sm1 while suppressing sound interferences of other non-focal areas. The echo cancellation module 18 performs echo cancellation on the signal Sm1 according to the signal Sp_R to accordingly provide a signal Sm2. The speech recognition module 22 then utilizes the signal Sm2 for speech recognition, and identifies whether the signal Sm2 contains a voice control command and associated contents of the command. Thus, the controller 20 is enabled to accordingly control the audio device 10.

Known from FIG. 1, the conventional audio device 10 performs echo cancellation after having performed beamforming. Under such conventional architecture, although the controller 20 requires only one single echo cancellation module 18 and thus has a reduced computation amount, the beamforming may nevertheless destruct the linearity of the echo and generate non-linear signals. As a result, the echo cancellation module 18 may fail to completely eliminate the echo to undesirably affect the accuracy and recognition rate of speech recognition.

SUMMARY OF THE INVENTION

It is an object of the present invention to provide a controller for an audio device. The audio device receives a first collected sound signal and a second collected sound signal respectively provided by two microphones, and includes an echo cancellation module and a beamforming module. The echo cancellation module performs echo cancellation on the first collected sound signal to accordingly provide an intermediate signal. The beamforming module, coupled to the echo cancellation module, receives the second collected sound signal and performs beamforming by utilizing the intermediate signal and the second collected sound signal to accordingly provide an output signal. The second collected sound signal is non-echo-cancelled. The controller may further include a speech recognition module. The speech recognition module, coupled to the beamforming module, performs speech recognition on the output signal and controls the audio device according to a result of the speech recognition.

The audio device of the present invention may include one or multiple speakers, an audio output module and a playback module. The audio output module provides an audio source signal for each of the speakers. The playback module causes the speakers to play corresponding sounds according to the audio signals. The echo cancellation signal performs echo cancellation on the first collected sound signal according to the audio source signals.

It is another object of the present invention to provide an operation method for an audio device. The operation method includes: receiving a first collected sound signal and a second collected sound signal from a first microphone and a second microphone, respectively; performing echo cancellation on the first collected sound signal to accordingly provide an intermediate signal; and performing beamforming according to the intermediate signal and the second collected sound signal to accordingly provide an output signal. The second collected sound signal is non-echo-cancelled.

The above and other aspects of the invention will become better understood with regard to the following detailed description of the preferred but non-limiting embodiments. The following description is made with reference to the accompanying drawings.

BRIEF DESCRIPTION OF THE DRAWINGS

FIG. 4 is an exemplary comparison on echo cancellation effects and computation amounts of FIG. 1 to FIG. 3;

DETAILED DESCRIPTION OF THE INVENTION

Figure 2:
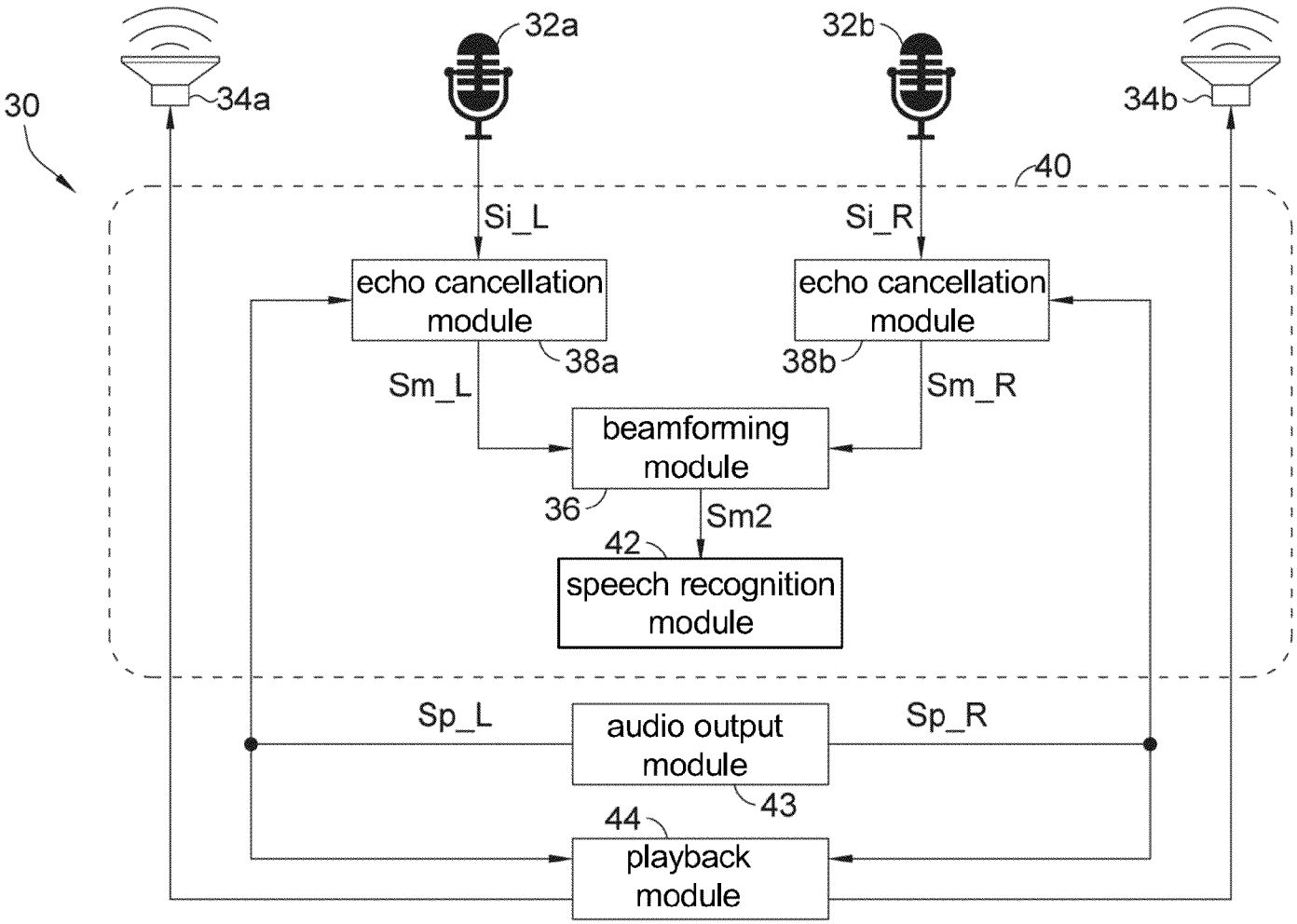
FIG. 2 is a schematic diagram and an audio device and its controller.

FIG. 2 is a schematic diagram of an audio device 30. The audio device 30, capable of playing sounds and receiving voice control, includes microphones 32*a* and 32*b*, speakers 34*a* and 34*b*, a controller 40, an audio output module 43, and a playback module 44. The microphones 32*a* and 32*b* are for collecting sounds to accordingly provide electronic signals Si_L and Si_R that are transmitted to the controller 40.

The controller 40 includes two echo cancellation modules 38*a* and 38*b*, a beamforming module 36 and a speech recognition module 42. The audio output module 43 provides signals Sp_L and Sp_R as audio source signals. The playback module 44 controls the speakers 34*a* and 34*b* according to the signals Sp_L and Sp_R to play the signals Sp_L and Sp_R as sounds.

To realize the voice control function, the audio signal 30 is similarly required to focus and collect sounds to prevent playback echoes of the speakers 34*a* and 34*b* from interfering with the sound collection. In the controller 40 of the audio device 30, the echo cancellation modules 38*a* and 38*b* first cancel the echoes from the signals Si_L and Si_R according to the signals Sp_L and Sp_R to generate signals Sm_L and Sm_R. Then, the beamforming module 36 utilizes the signals Sm_L and Sm_R to perform beamforming to accordingly generate a signal Sm2 as an output signal. Thus, the speech recognition module 42 may utilize the signal Sm2 for speech recognition to allow the controller 40 to accordingly control the audio device 30.

Figure 1:
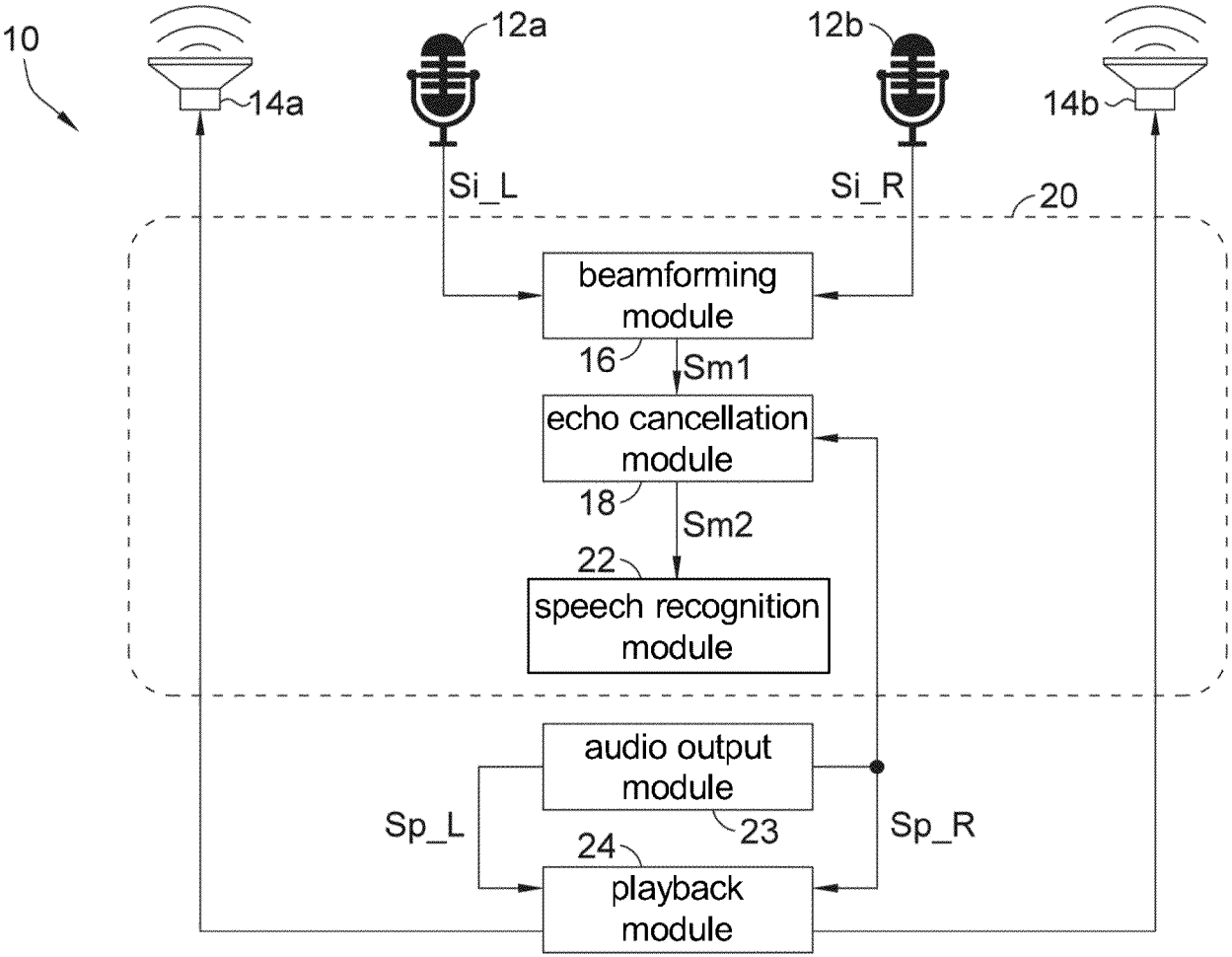
FIG. 1(prior art)
FIG. 1 is a schematic diagram of a controller of a conventional audio device.

Different from the prior art in FIG. 1, the controller architecture in FIG. 2 first performs balanced echo cancellation of two paths and then performs beamforming, so as to prevent the beamforming from destructing echo characteristics. However, the balanced echo cancellation of two paths in FIG. 2 may involve a larger computation amount.

Figure 3:
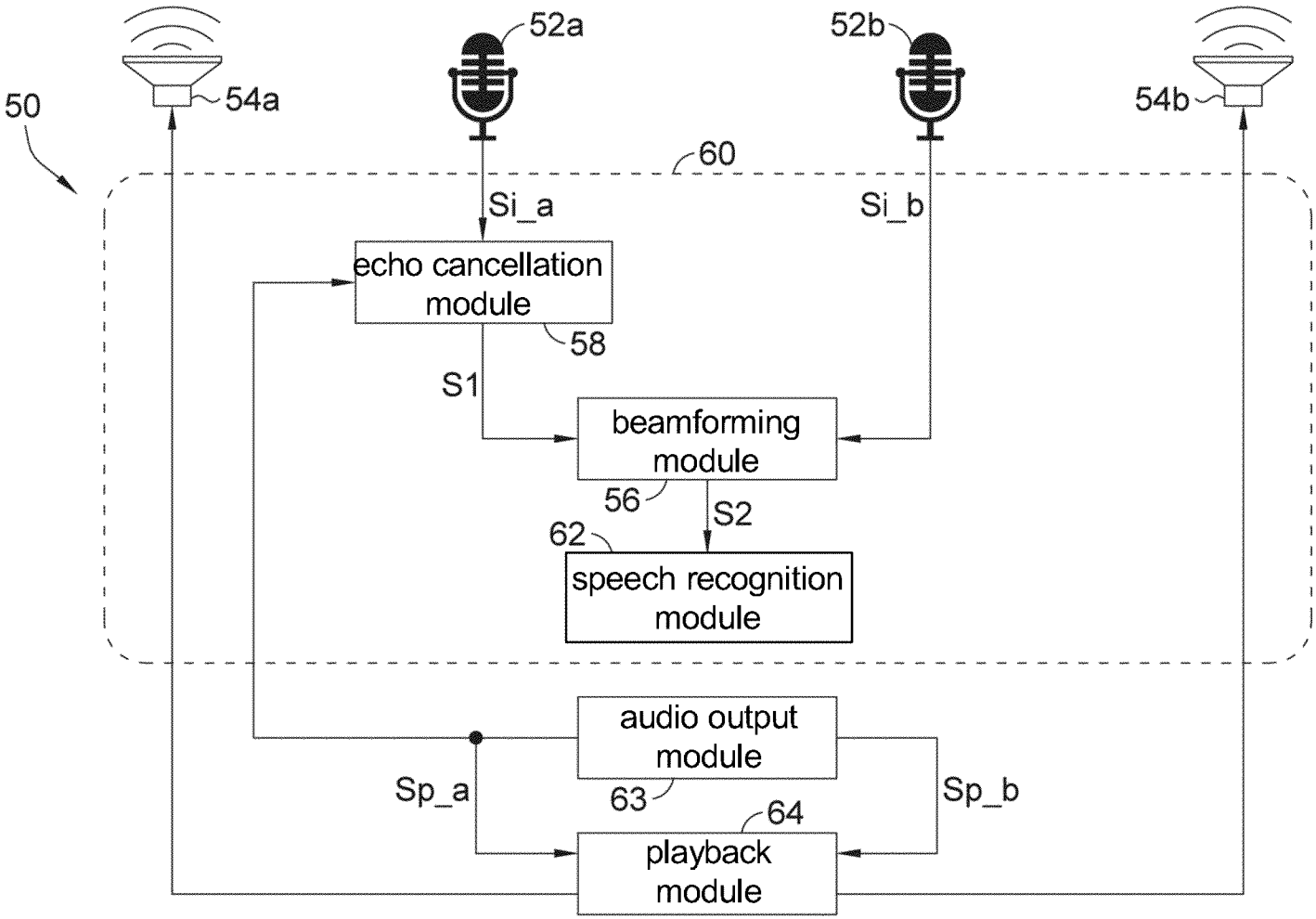
FIG. 3 is a schematic diagram of an audio device and its controller according to an embodiment of the present invention.

FIG. 3 shows a schematic diagram of an audio device 50 according to an embodiment of the present invention. For example, the audio device 50 may be a device capable of playing sounds and receiving voice control, e.g., a voice-controlled television or a voice-controlled multimedia player. The audio device 50 may include one or more microphones (e.g., microphones 52*a* and 52*b*), one or more speakers (e.g., speakers 54*a* and 54*b*), an audio output module 63, a playback module 64, and a controller 60. The microphones 52*a* and 52*b* collect sounds, and convert the collected sounds to electronic signals Si_a and Si_b (may be regarded as first and second collected sound signals) that are then transmitted to the controller 60.

The controller 60 may be a processor or a controller chip, or may include peripheral supporting circuits and/or hardware of the controller chip, e.g., a volatile and/or non-volatile memory. The controller 60 may include one single echo cancellation module 58, a beamforming module 56 and a speech recognition module 62. In the audio device 50, the audio output module 63 provides signals Sp_a and Sp_b (may be regarded as audio source signals), and the playback module 64 drives the speakers 54*a* and 54*b* according to the signals Sp_a and Sp_b to play the signals Sp_a and Sp_b as corresponding sounds. For example, the audio output module 63 may include an audio coder/decoder (codec) module that retrieves signals of different channels from a stereo audio source stream (not shown) as audio source signals of different speakers, e.g., the signals Sp_a and Sp_b of the speakers 54*a* and 54*b*.

The audio device 50 is capable of focusing and collecting sounds as well as suppressing an echo resulted by sound playback of speakers. For example, to realize the voice control function, the audio device 50 may focus a position of a user to centrally collect a voice control command issued by the user, and prevent the sound playback of the speakers 54*a* and 54*b* from affecting the sound collection. In the controller 60, the echo cancellation module 58, coupled to the microphone 52*a*, the beamforming module 56 and the audio output module 63, receives the signal Sp_a and performs echo cancellation on the signal Si_a according to the signal Sp_a to accordingly provide a signal S1 as an intermediate signal. The beamforming module 56, coupled to the echo cancellation module 58, the microphone 52*b* and the speech recognition module 62, performs beamforming by utilizing the signal S1 and the signal Si_b of the microphone 52*b* to accordingly provide a signal S2 as an output signal. The speech recognition module 62, coupled to the beamforming module 56, performs speech recognition on the signal S2 to allow the controller 60 to control the audio device 50 according to a result of the speech recognition.

Known from FIG. 3, the controller 60 of the present invention performs the echo cancellation before the beamforming, thereby preventing non-linear signals of the beamforming from affecting echo cancellation effects and further preventing the beamforming from affecting the speech recognition rate and accuracy. For example, the echo cancellation may be performed by utilizing a normalized least mean square (NLMS) algorithm. However, when performing echo cancellation on a certain audio source signal, as the number of processes (e.g., space reflection, non-linear resonance and/or beamforming) that the signals has previously undergone gets larger, an approximation for a coefficient inputted into an echo adaptive filter by utilizing the processed audio source signal with the NLMS algorithm can become more challenging. Thus, if beamforming is placed before echo cancellation, the echo cancellation module may be further hindered from learning a filter coefficient for echo cancellation, meaning that the echo cancellation is made even more difficult. In comparison, the controller architecture of the present invention arranges beamforming before echo cancellation, thereby effectively preventing beamforming from sabotaging echo cancellation effects.

Further, the controller 60 of the present invention is capable of realizing one single echo cancellation module 58. Thus, the computation amount of the controller 60 may be reduced to avoid additional computation amounts that the multiple echo cancellation modules in FIG. 2 require. Although the controller 60 only performs echo cancellation on the signal Si_a provided by the microphone 52*a* but not on the signal Si_b provided by the microphone 52*b*, the echo in the signal Si_b is still processed, suppressed and eliminated by the beamforming performed by the beamforming module 56 according to the embodiment of the present invention. Therefore, in general, the echoes in the signals Si_a and Si_b do not interfere with the speech recognition rate.

One object of beamforming is to enhance sounds near a focal area and to in contrast suppress sounds of non-focal areas. For example, the focal area may be located at a geometric center line of the microphones 52*a* and 52*b*. That is to say, distances from the microphones 52*a* and 52*b* to the focal area are similar, and so performances that the sound from the focal area presents in the signals Si_a and Si_b are also similar. If a sound presents different performances in the signals Si_a and Si_b or is only presented in one of the signals Si_a and Si_b, it can be determined that the sound is from a non-focal area. In an embodiment of the present invention, the signal Si_b of the microphone 52*b* is non-echo-cancelled, and the echo of the signal Si_b only appears in the signal Si_b from the microphone 52*b* but not in the signal S1 from the echo cancellation module 58. Thus, the signal Si_b is determined by the beamforming module 56 as a sound from a non-focal area, and the beamforming module 56 performs echo cancellation by beamforming to filtered out the echo from the signal Si_b.

FIG. 4 is an exemplary comparison on echo cancellation effects and computation amounts of FIG. 1 to FIG. 3. In FIG. 4, the echo cancellation effect is quantized by echo return loss enhancement (ERLE), and gets better as the ERLE value gets higher. The computation amount is represented by clocks that echo cancellation requires, and the consumed computation gets less as the value of required clocks gets lower. It is known from FIG. 4, the controller architecture (FIG. 3) of the present invention satisfies both the echo cancellation effect and low computation amounts; that is, the controller architecture provides not only a good echo cancellation effect but also a low computation amount.

In the embodiment in FIG. 3, the speech recognition module 62 may also a module of other functions. For example, the speech recognition module 62 may be a recording module (for recording the signal S2 to a non-volatile memory), a transmitting module (for transmitting the signal S2 to a network), and/or an audio processing module, e.g., an encoding module (for encoding the signal S2 into a stream) or a spectrum converting module (for converting the signal S2 to a frequency domain). The modules of the controller 60 may be implemented by exclusive hardware, and/or by executing software and/or firmware programs using a hardware processor.

Figure 5:
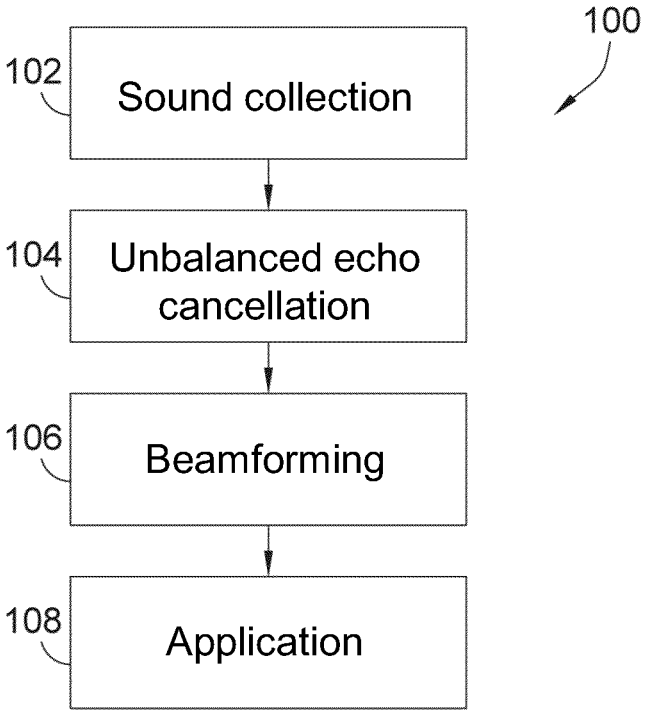
FIG. 5 is a flowchart of an operation method according to an embodiment of the present invention.

FIG. 5 shows a flowchart 100 of according to an embodiment of the present invention. The flowchart 100 is applicable to the audio device in FIG. 3, and includes the following steps.

In step 102, a plurality of collected sound signals are provided by a plurality of microphones. For example, the signals Si_a and Si_b are provided by the microphones 52*a* and 52*b* (FIG. 3), respectively.

In step 104, among the plurality of sound collected signals, echo cancellation is performed on a part (one or multiple) of the signals, and echo cancellation is not performed on the remaining one or multiple sound collected signals. For example, in the embodiment of FIG. 3, echo cancellation is performed on the signal Si_a according to the signal Sp_a to form the signal S1 (the intermediate signal), and echo cancellation is not performed on the signal Si_b.

In step 106, the echo-cancelled signal (e.g., the signal S1) and the non-echo-cancelled signal (e.g., the signal Si_b) are combined for beamforming to accordingly to provide an output signal, e.g., the signal S2 in FIG. 3.

In step 108, the output signal provided by step 106 is applied. For example, speech recognition is performed on the output signal S2, and the audio device 50 is controlled according to a result of the speech recognition.

In conclusion, the present invention may be applied as follows. The controller of the present invention may receive a plurality of collected sound signals provided by a microphone array (e.g., multiple microphones). Echo cancellation is performed on a part (one or multiple) of the collected sound signals, and not performed on the remaining (one or multiple) collected sound signals. Further, the echo-cancelled collected sound signal(s) and the non-echo-cancelled collected sound signal(s) are combined and integrated for beamforming to achieve focused sound collection and echo cancellation. In other words, signals provided by different microphones are echo cancelled in an unbalanced manner, and focused sound collection and echo cancellation are then integrated and implemented by beamforming. Compared to the prior art, the present invention is capable of preventing beamforming from affecting echo cancellation, and is not required to perform echo cancellation on all sound channels, thereby providing a good echo cancellation effect as well as a minimal computation amount.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A controller for an audio device, receiving a first collected sound signal and a second collected sound signal provided by two microphones, respectively, the controller comprising:

an echo cancellation module, configured to perform echo cancellation on the first collected sound signal to accordingly provide an intermediate signal; and a beamforming module, configured to perform beamforming according to the intermediate signal and the second collected sound signal to accordingly provide an output signal, wherein the echo cancellation is not performed on the second collected sound signal.

2. The controller according to claim 1, wherein the audio device comprises an audio output module and a playback module, the playback module performs playback according to an audio signal outputted from the audio output module, and the echo cancellation module performs the echo cancellation on the first collected sound signal according to the audio signal.

3. The controller according to claim 1, further comprising:

a speech recognition module, configured to perform speech recognition on the output signal.

4. The controller according to claim 3, further controlling the audio device according to a result of the speech recognition.

5. An operation method for an audio device, the operation method comprising:

receiving a first collected sound signal and a second collected sound signal from a first microphone and a second microphone, respectively;

performing echo cancellation on the first collected sound signal to accordingly provide an intermediate signal; and performing beamforming according to the intermediate signal and the second collected sound signal to accordingly provide an output signal, wherein the echo cancellation is not performed on the second collected sound signal.

6. The operation method according to claim 5, wherein the audio device comprises an audio output module and a playback module, the playback module performs playback according to an audio signal outputted from the audio output module, and the step of performing the echo cancellation on the first collected sound signal to accordingly provide the intermediate signal is performed according to the audio signal.

7. The operation method according to claim 5, further comprising performing speech recognition on the output signal.

8. The operation method according to claim 5, further comprising controlling the audio device according to a result of the speech recognition.

* * * * *